US007315318B2

(12) United States Patent
Huang

(10) Patent No.: US 7,315,318 B2
(45) Date of Patent: Jan. 1, 2008

(54) IMAGING PROCESSING METHOD BY ADJUSTING HEATING TIME

(75) Inventor: Kuang-Huei Huang, Taipei (TW)

(73) Assignee: Hi-Touch Imaging Technologies Co., Ltd., Pan-Chiao, Taipei Hsien (TW)

( * ) Notice: Subject to any disclaimer, the term of this patent is extended or adjusted under 35 U.S.C. 154(b) by 262 days.

(21) Appl. No.: 10/906,839

(22) Filed: Mar. 8, 2005

(65) Prior Publication Data

US 2006/0132582 A1 Jun. 22, 2006

(30) Foreign Application Priority Data

Dec. 17, 2004 (TW) ..... 93139443 A

(51) Int. Cl.
*B41J 2/00* (2006.01)

(52) U.S. Cl. ..... 347/188

(58) Field of Classification Search ..... None
See application file for complete search history.

*Primary Examiner*—K. Feggins
(74) *Attorney, Agent, or Firm*—Winston Hsu

(57) ABSTRACT

A method for image processing by adjusting heating time includes providing a first heating table corresponding to a relationship between a first color density and a first heating time and a second heating table corresponding to a relationship between a color degree and a second heating time based on a printing parameter. The method further comprises providing a function corresponding to a relationship between a second color density and the color degree based on the first heating table and the second heating table, wherein the second heating time has a one-to-one relationship with the color degree, and the color degree has a one-to-one relationship with the second color density.

6 Claims, 19 Drawing Sheets

IMAGING PROCESSING METHOD BY ADJUSTING HEATING TIME

BACKGROUND OF INVENTION

1. Field of the Invention

The present invention is related to an image processing method by adjusting heating time, and more particularly, to an image processing method applied on a thermal printer by adjusting heating time.

2. Description of the Prior Art

With the rapid development of digital cameras, the amount of digital images has increased tremendously. Though digital images can be viewed on display devices such as computer screens or televisions, so far these display devices have not been able to replace the need for paper photos completely. It is because people have become accustomed to enjoying images in the form of paper photos, and the feeling of holding photos and the pleasure of sharing them with someone around you can not be changed in a short time. Therefore, many printer manufacturers focus on printers with photo printing functions. In the consumer market, the demand for photo printers that specialize in digital image printing also increases as higher quality photo printing is more often required these days.

Based on different printing technologies, photo printers can be categorized into three main types: the laser printer, the inkjet printer and the thermal printer. Although color laser printers are available widely in the consumer market, laser printers are usually not a popular choice for photo printers due to higher prices and worse color expression in photo printing. The developments on photo printers are mainly focused on the inkjet printer and the thermal printer. An inkjet printer is a half-tone printing device that uses the dithering technique to place extremely small droplets of ink onto the paper to create an image. The purpose of the dithering technique is to create photo-quality images with these tiny dots as close to those seen by bare human eyes as possible. The half-tone technology cannot match the continuous-tone technology in printing effects. One can clearly distinguish the difference in printing quality between a half-tone photo printing and a continuous-tone photo printing, especially when the photos are being enlarged.

A thermal printer is a continuous-tone printing device that drives its thermal print head (TPH) based on image signals. When the temperature of the TPH is increased, it heats ribbons containing dyes and then diffuses the dyes onto specially coated paper or transparencies. Since the temperature of the TPH controls the amount of dye being transferred, a thermal dye transfer printer can express more color degrees and produce continuous-tone images that mimic actual photographs. Compared to other printing techniques, the thermal printer can produce continuous-tone and lifelike color images that best match the traditional paper photos. Due to its excellent printing quality and the natural, continuous color expression, the thermal printer is particularly suitable for photo printing applications.

Before printing digital images, image processing is usually necessary to achieve different printing effects. In the analog technology of a thermal printer, the heating time of the TPH is decided by the strength of the image signals and the amount of dye being transferred is controlled by the temperature of the TPH. To achieve the color density required by each color degree, usually several predetermined heating tables are provided to control the heating time of the TPH in accordance with each color degree, as illustrated in FIG. 1 through FIG. 3:

FIG. 1 shows the relationship between the color density D(t) and the heating time t.

FIG. 2 shows the relationship between the color degree T(x) and the heating time t:

$$tx=T(x),\ x=0\text{-}255$$

FIG. 3 shows the relationship between the color density D(x)and the color degree x based on FIG. 1 and FIG. 2:

$$dx=D(tx)=D(T(x)),\ x=0\text{-}255;$$

where x represents the color degree;

dx represents the color density each color degree x corresponds to; and tx represents the amount of heating time required to achieve the color degree x.

In the prior art image processing method, a predetermined heating table tx is first decided, and then a function dx is obtained, showing the relationship between the color density and the color degree. During the image processing procedures, the color degrees of different printing parameters are adjusted respectively to achieve the required color density according to each printing parameter.

The following formulae illustrate a prior art image processing method for a printing parameter brightness:

$$B(x)=x+\Delta x,\ \text{when } 0\leqq(x+\Delta x)\leqq 255; \qquad \text{formula 1:}$$

$$B(x)=255,\ \text{when } (x+\Delta x)>255; \qquad \text{formula 2:}$$

$$B(x)=0,\ \text{when } (x+\Delta x)<0; \qquad \text{formula 3:}$$

where x is original color degree, x=0-255;

Δx is the amount of brightness adjustment; and

B(x) is the color degree of the parameter brightness after brightness adjustment.

In the prior art image processing method for brightness, the color degree of the brightness parameter is being adjusted and Δx represents the amount of brightness adjustment. FIG. 4 shows the relationship between the color degree B(x) and the original color degree x after brightness adjustment (Δx>0). FIG. 5 shows the relationship between the color degree B(x) and the original color degree x after brightness adjustment (Δx<0). After brightness adjustment in the prior art method, some color degrees correspond to the same values of B(x). When x is greater than a certain value, the corresponding B(x) values are all 255, as illustrated in FIG. 4 and formula 2; when x is smaller than a certain value, the corresponding B(x) values are all 0, as illustrated in FIG. 5 and formula 3. These result in indistinguishable color degrees after brightness adjustment. Based on FIG. 3 and FIG. 4, FIG. 6 shows the corresponding relationship between the color density and the color degree after brightness adjustment (Δx>0). Based on FIG. 3 and FIG. 5, FIG. 7 shows the corresponding relationship between the color density and the color degree after brightness adjustment (Δx<0). In the prior art image processing method for brightness, the color degree of the brightness is being adjusted. Some color degrees which have different x values during brightness adjustment can correspond to the same values of B(x) and color density after brightness adjustment. Therefore some color degrees are indistinguishable in the prior art image processing method for brightness adjustment.

The following formulae illustrate a prior art image processing method for a printing parameter contrast:

$$C(x)=\mathrm{Int}(x-128)*R+128, \text{ when } 0\leqq(x-128)*R+128\leqq 255; \quad \text{formula 4:}$$

$$C(x)=255, \text{ when } (x-128)*R+128>255; \quad \text{formula 5:}$$

$$C(x)=0, \text{ when } (x-128)*R+128<0; \quad \text{formula 6:}$$

where x represents the original color degree, x=0-255;

R is a parameter for contrast adjustment; and

C(x) represents the color degree of the parameter contrast after contrast adjustment.

In the prior art image processing method for contrast, the color degree of the contrast parameter is being adjusted and R is a parameter for contrast adjustment. FIG. 8 shows the relationship between the color degree C(x) and the original color degree x after contrast adjustment (R>0). FIG. 9 shows the relationship between the color degree C(x) and the original color degree x after contrast adjustment (R<0). After contrast adjustment in the prior art method, some color degrees correspond to the same values of C(x). When (x−128)*R+128 is greater than a certain value, the corresponding C(x) values are all 255; when (x−128)*R+128 is smaller than a certain value, the corresponding C(x) values are all 0, as illustrated in FIG. 8, formula 5 and formula 6. These result in indistinguishable color degrees after contrast adjustment. Based on FIG. 3 and FIG. 8, FIG. 10 shows the corresponding relationship between the color density and the color degree after contrast adjustment (R>0). Based on FIG. 3 and FIG. 9, FIG. 11 shows the corresponding relationship between the color density and the color degree after contrast adjustment (R<0). In the prior art image processing method for contrast, the color degree of the contrast parameter is being adjusted. Some color degrees which have different x values during contrast adjustment can correspond to the same values of C(x) and color density after contrast adjustment. Therefore some color degrees can be indistinguishable in the prior art image processing method for contrast adjustment.

In the prior art image processing method, the color degrees of each printing parameters are adjusted. This method inevitably results in indistinguishable color degrees, which are undesirable during imaging processing procedures.

SUMMARY OF INVENTION

It is therefore an objective of the claimed invention to provide an image processing method by adjusting heating time in order to solve the problems in the prior art.

The claimed invention discloses an image processing method by adjusting heating time, the method comprising providing a first heating table corresponding to a relationship between a first color density and a first heating time, a second heating table corresponding to a relationship between a color degree and a second heating time based on a printing parameter, and a function corresponding to a relationship between a second color density and the color degree based on the first heating table and the second heating table, wherein the second heating time has a one-to-one relationship with the color degree, and the color degree has a one-to-one relationship with the second color density.

These and other objectives of the present invention will no doubt become obvious to those of ordinary skill in the art after reading the following detailed description of the preferred embodiment that is illustrated in the various figures and drawings.

DETAILED DESCRIPTION

Figure 2:
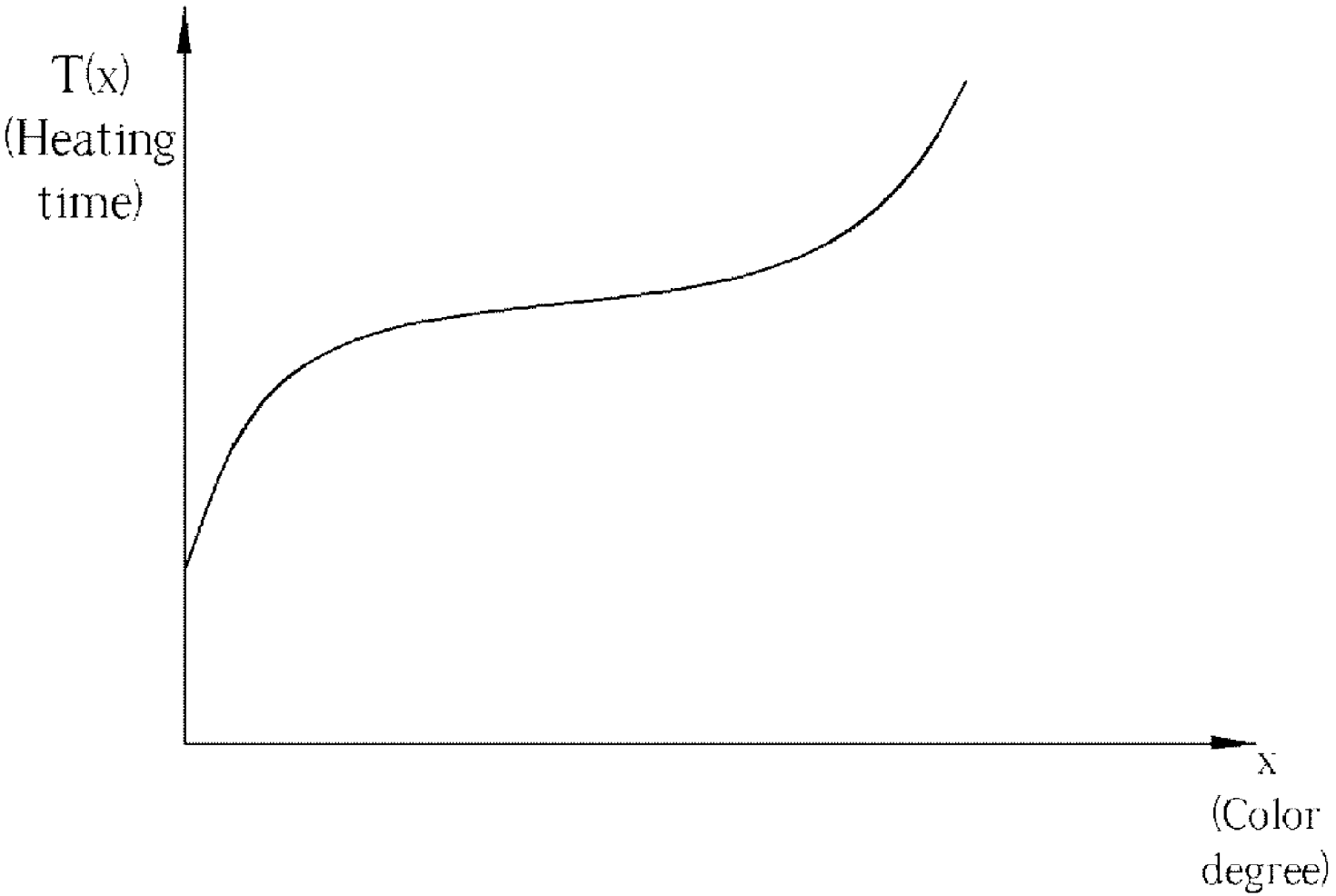
Fig. 2 Prior Art
FIG. 2 shows the relationship between the color degree and the heating time.
Figure 3:
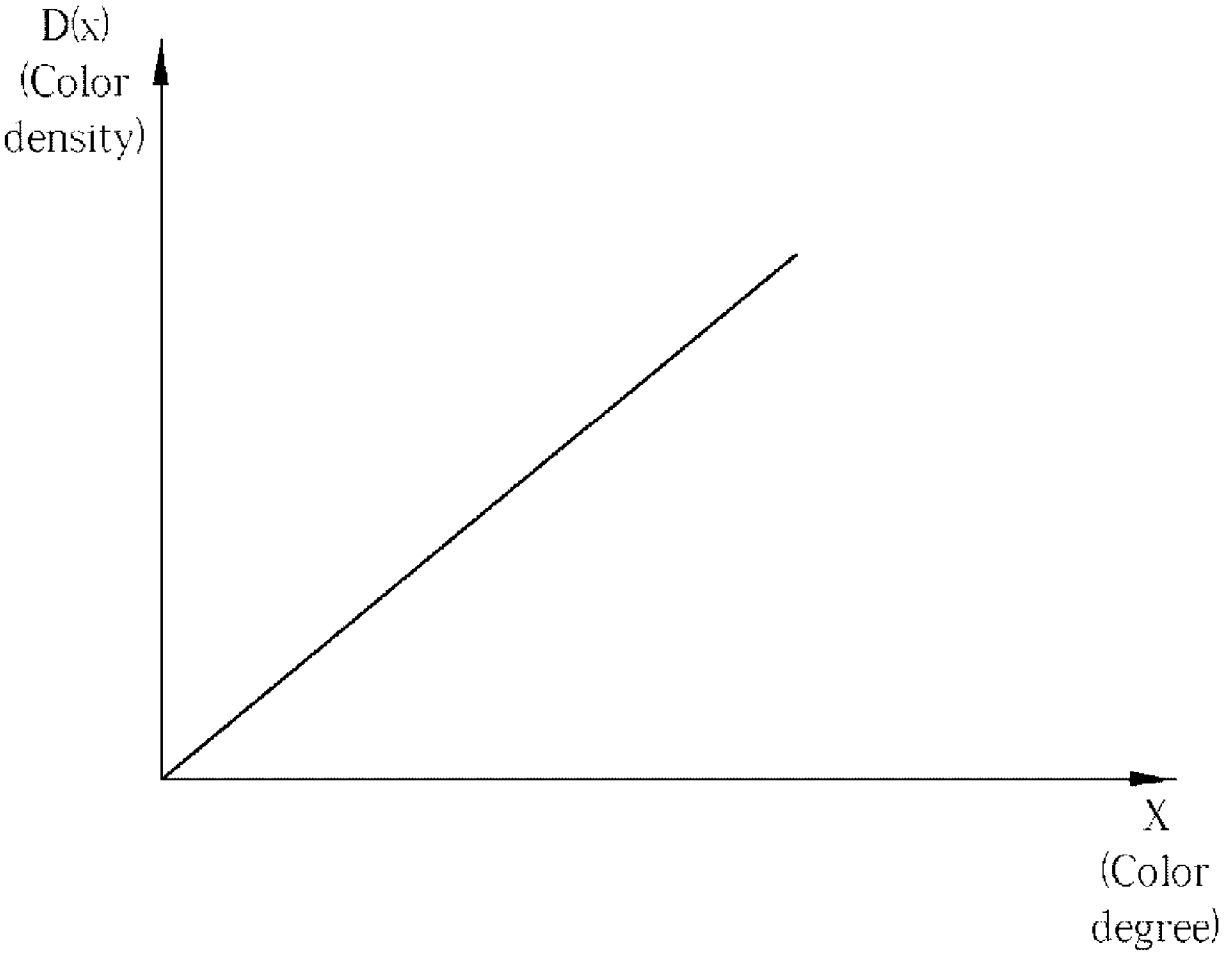
Fig. 3 Prior Art
FIG. 3 shows the relationship between the color density and the color degree based on the FIG. 1 and FIG. 2.
Figure 4:
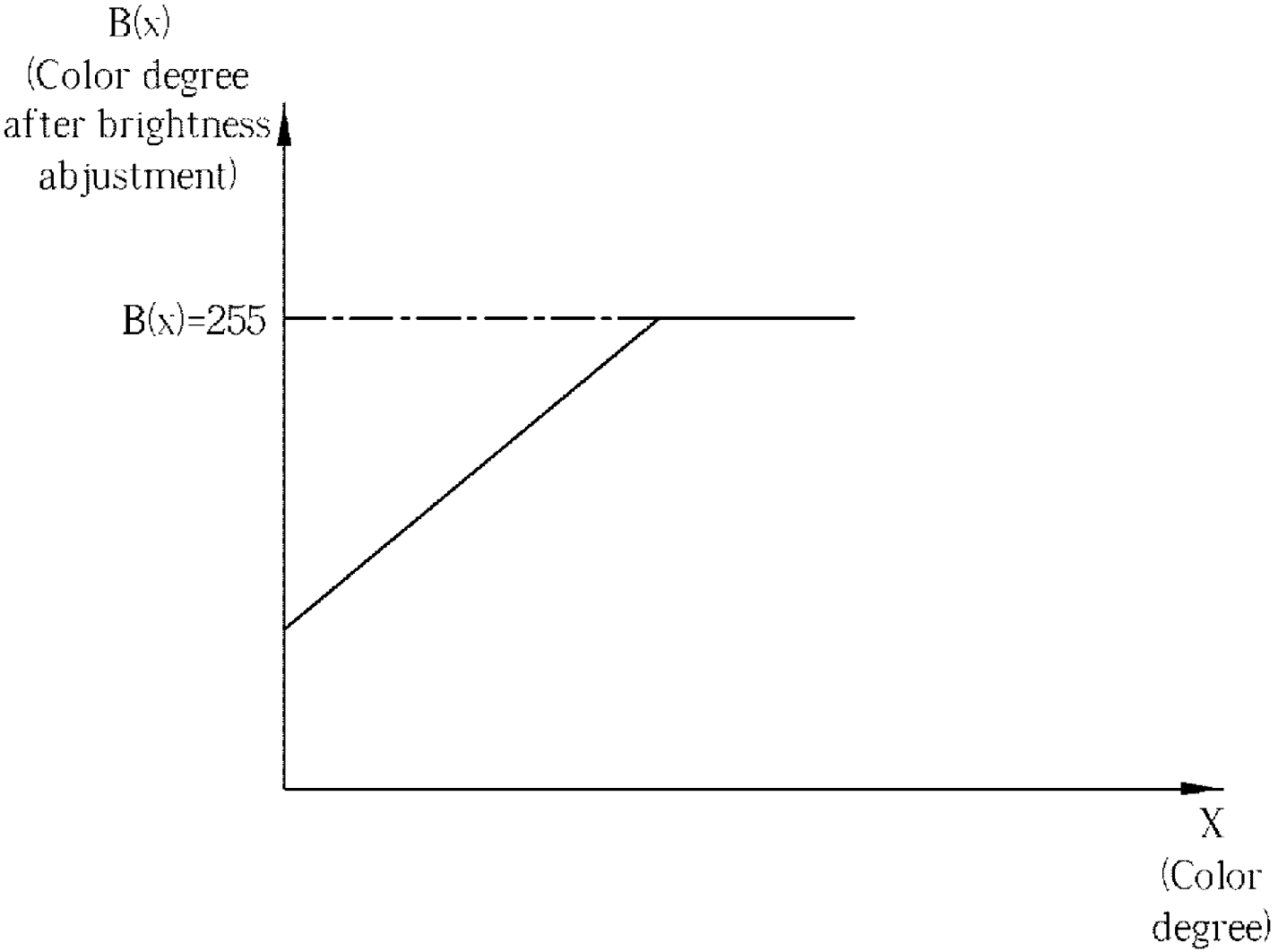
Fig. 4 Prior Art
FIG. 4 shows the relationship between the color degree B(x) and the original color degree x after brightness adjustment (Δx<0) in a prior art image processing method.
Figure 5:
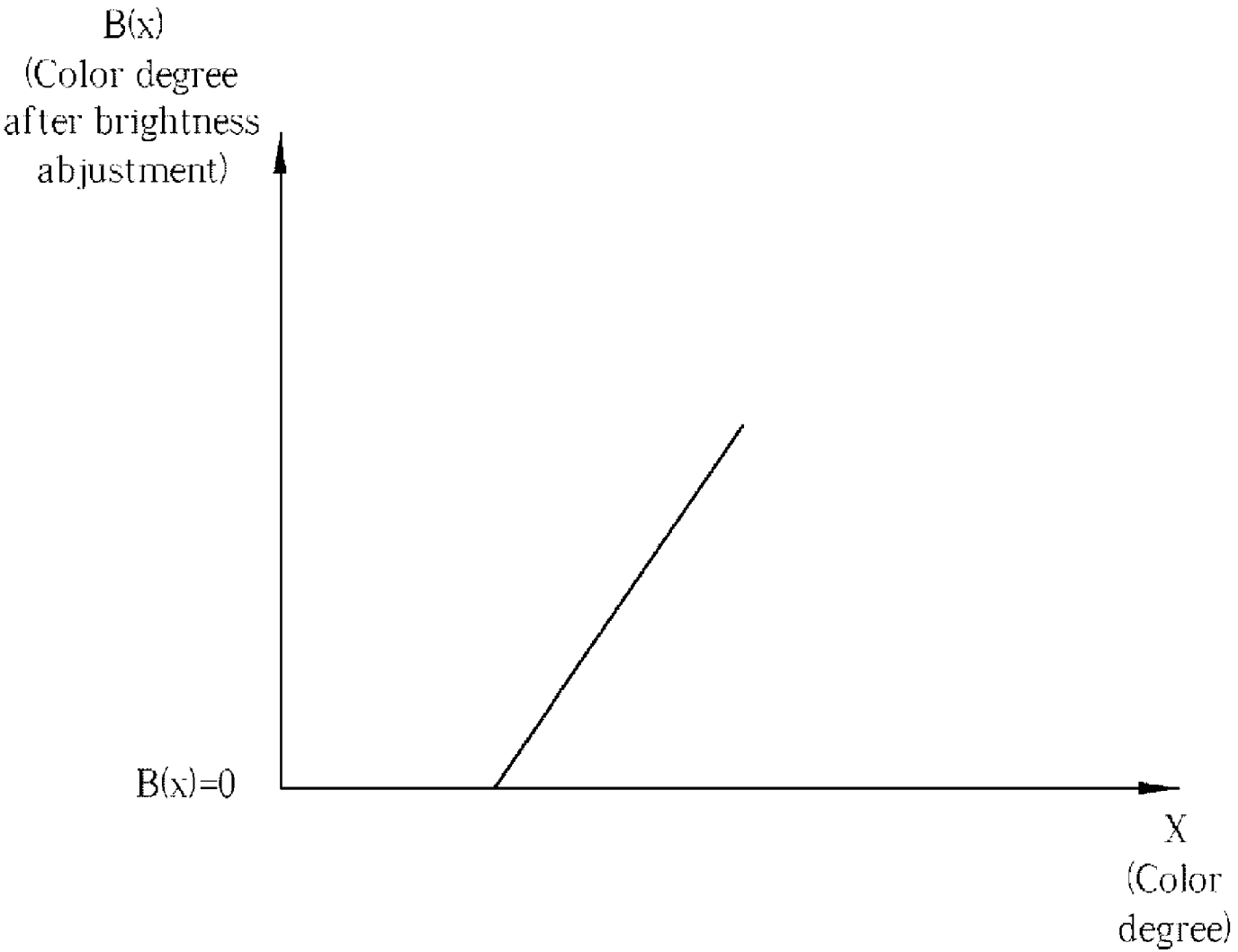
Fig. 5 Prior Art
FIG. 5 shows the relationship between the color degree B(x) and the original color degree x after brightness adjustment (Δx<0) in a prior art image processing method.

The following formulae illustrate an image processing method for the brightness parameter according to the present invention:

$$Tb(x)=T(x)+Tb(\Delta x),\ x=0\text{-}255; \quad \text{formula 7:}$$

where x is the color degree;

T(x) is the original heating time, as illustrated in FIG. 2; and

Tb(x) is the heating time after brightness adjustment.

Figure 1:
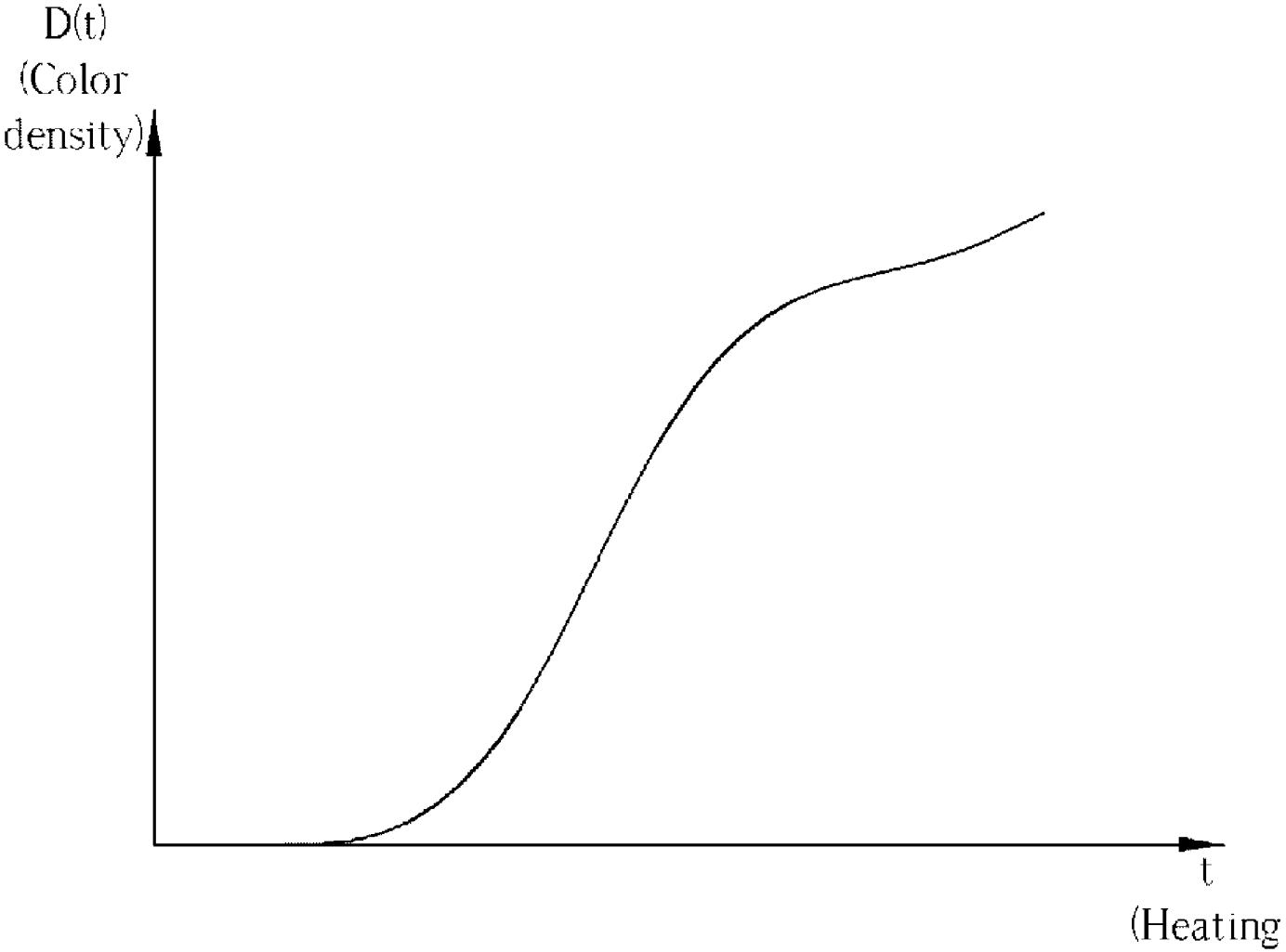
Fig.1 Prior Art
FIG. 1 shows the relationship between the color density D(t) and the heating time.

Based on FIG. 1 and formula 7, a formula 8 can be obtained to represent the relationship between the heating time and the color degree during brightness adjustment:

$$Db(x)=D(Tb(x)),\ x=0\text{-}255; \qquad \text{formula 8:}$$

where x is the color degree;

Tb(x) is the heating time after brightness adjustment, as illustrated in formula 1; and Db(x) is the color density after brightness adjustment.

Figure 6:
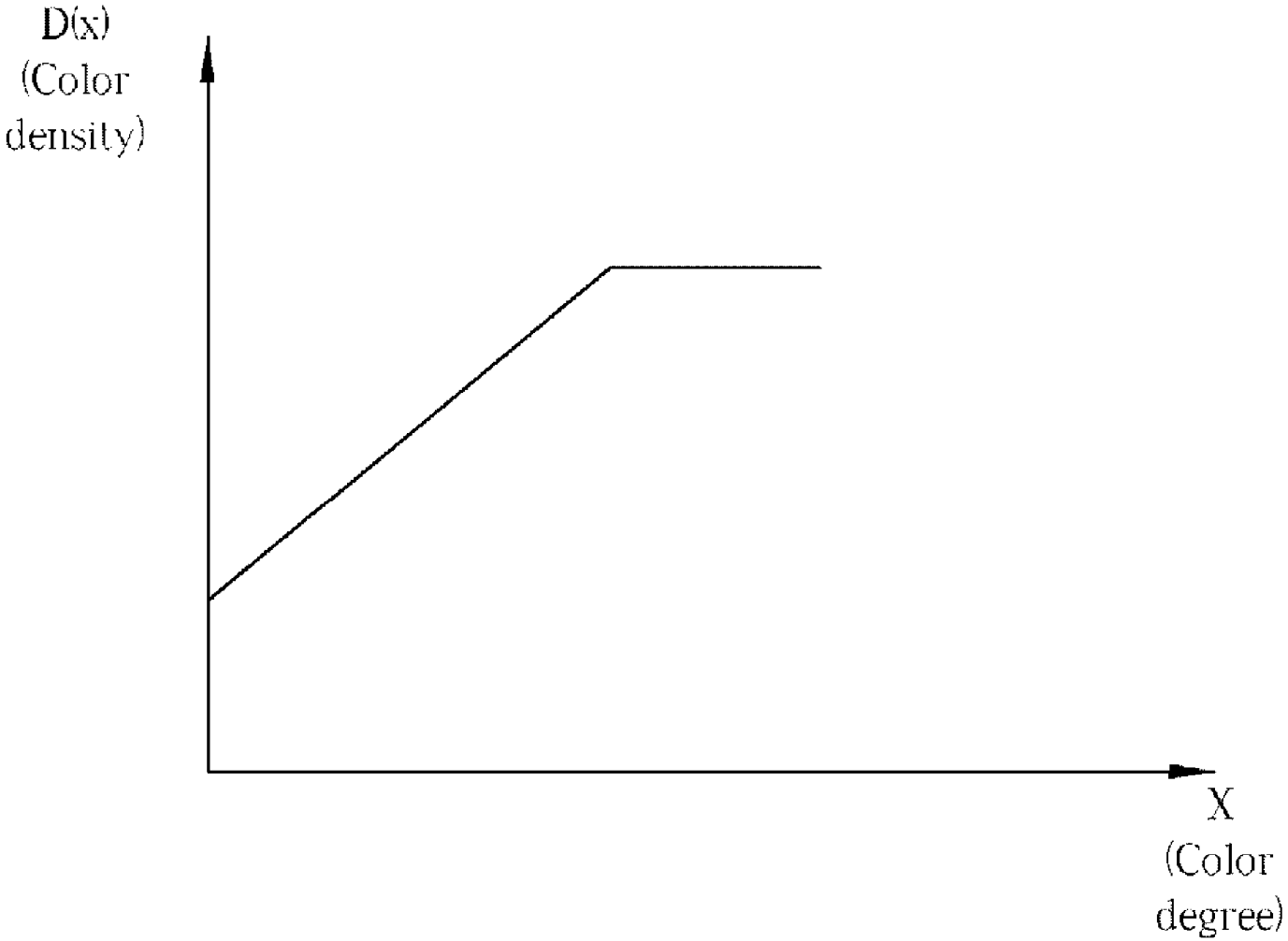
Fig. 6 Prior Art
FIG. 6 shows the relationship between the color density and the color degree after brightness adjustment (Δx>0) based on FIG. 3 and FIG. 4 in a prior art image processing method.
Figure 7:
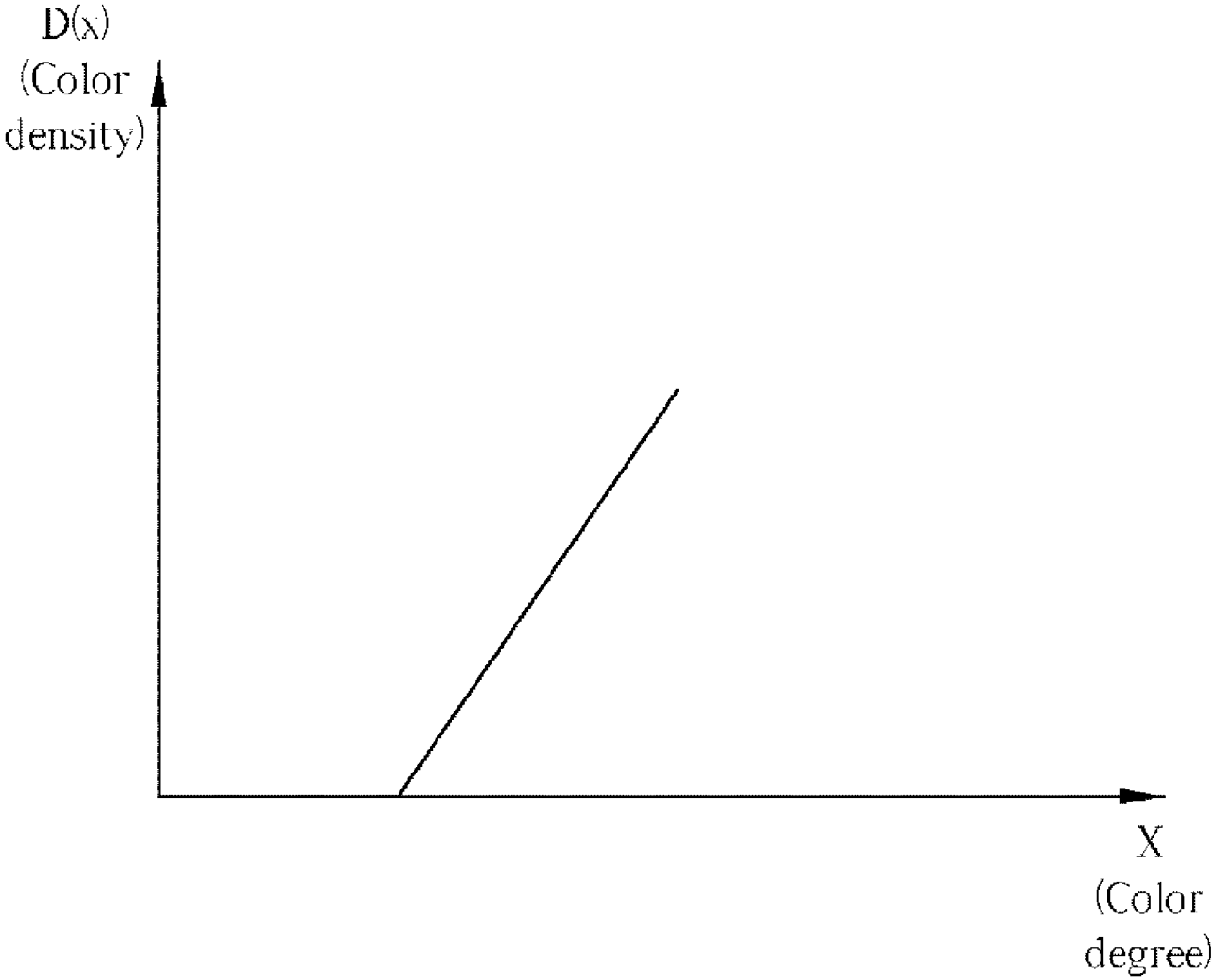
Fig. 7 Prior Art
FIG. 7 shows the relationship between the color density and the color degree after brightness adjustment (Δx<0) based on FIG. 3 and FIG. 5 in a prior art image processing method.
Figure 8:
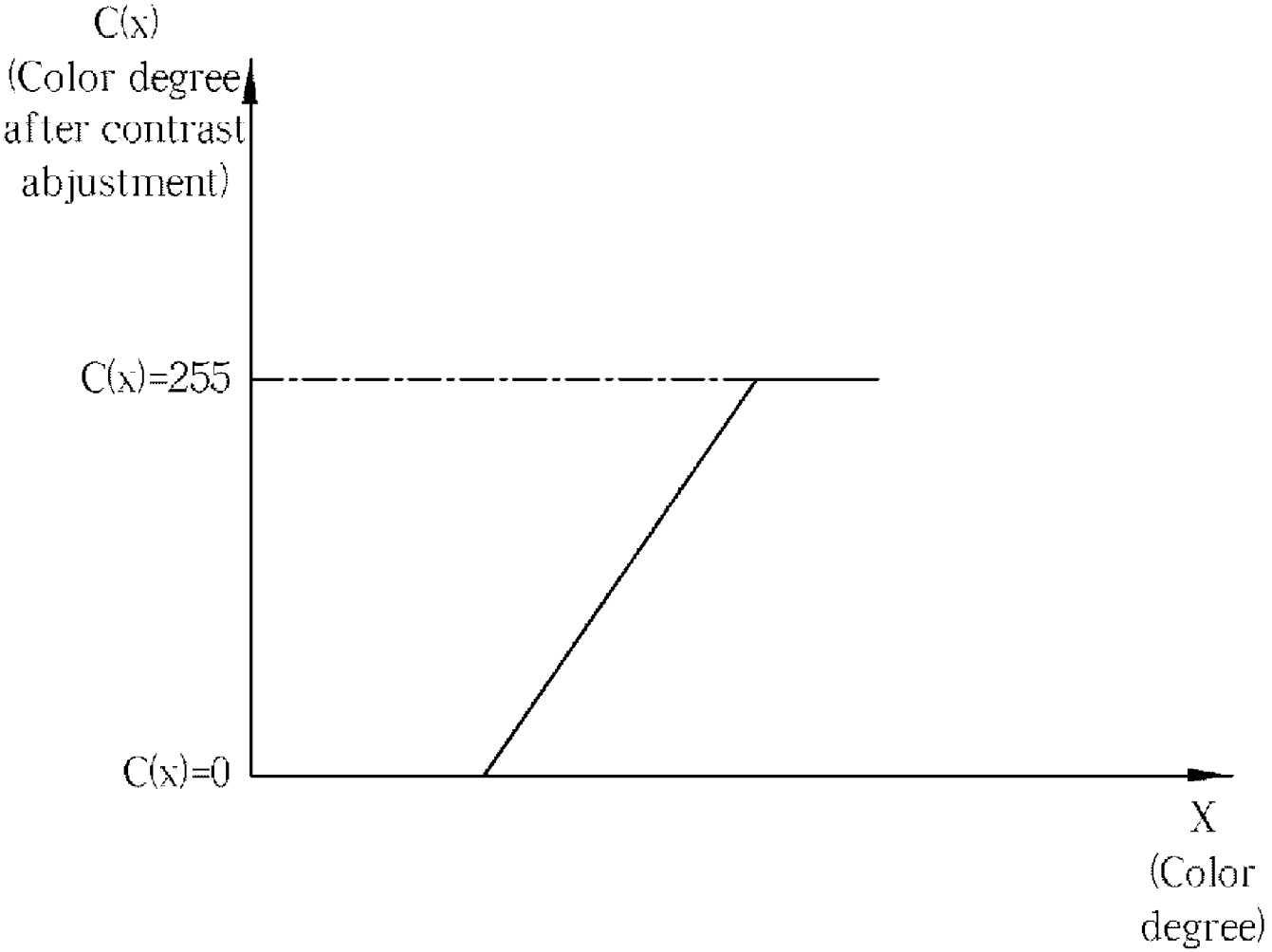
Fig. 8 Prior Art
FIG. 8 shows the relationship between the color degree C(x) and the original color degree x after contrast adjustment (R>0) in a prior art image processing method.
Figure 9:
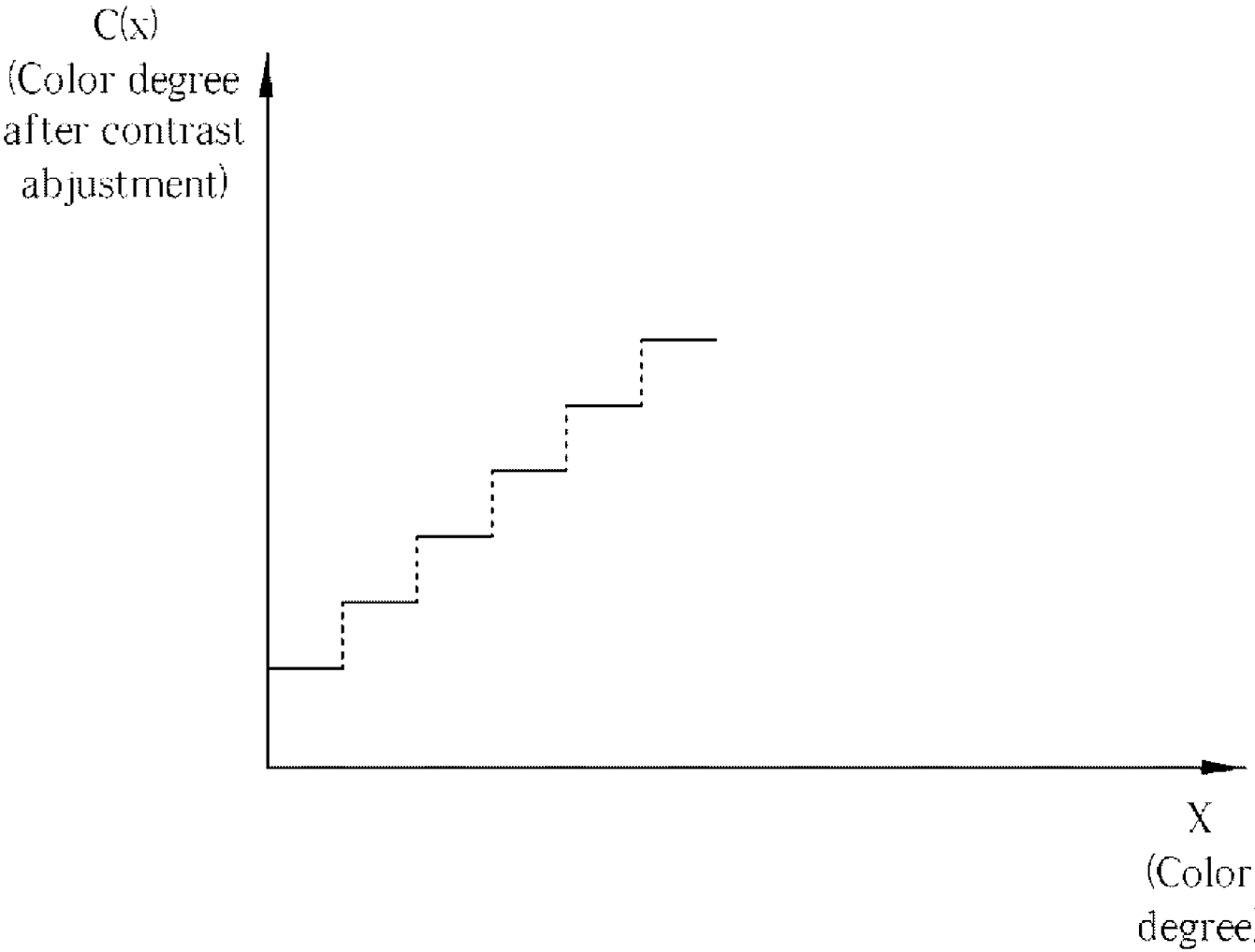
Fig. 9 Prior Art
FIG. 9 shows the relationship between the color degree C(x) and the original color degree x after contrast adjustment (R<0) in a prior art image processing method.
Figure 12:
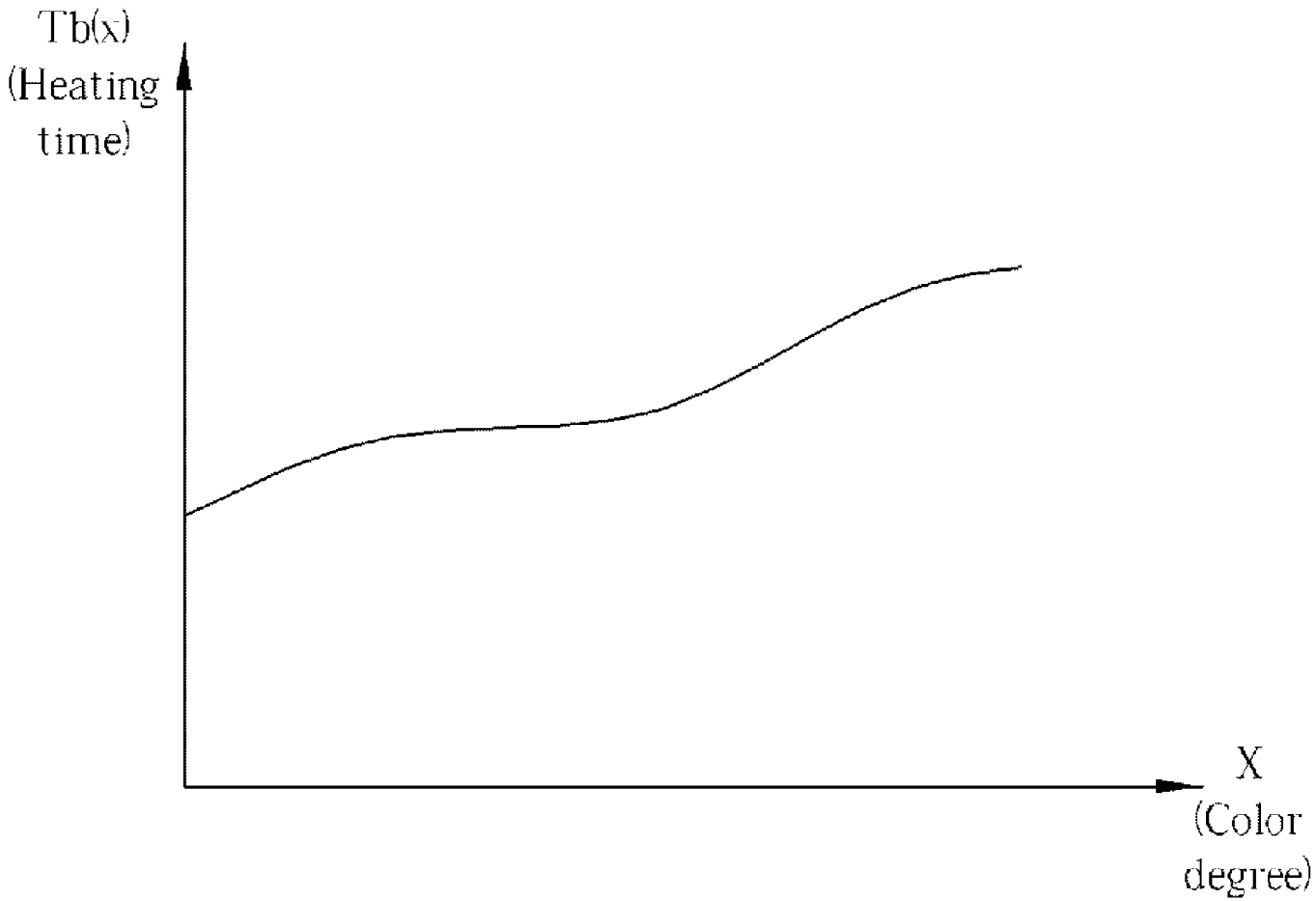
FIG. 12 shows the relationship between the heating time Tb(x) and the original color degree x after brightness adjustment (Δx>0) in the present invention.
Figure 13:
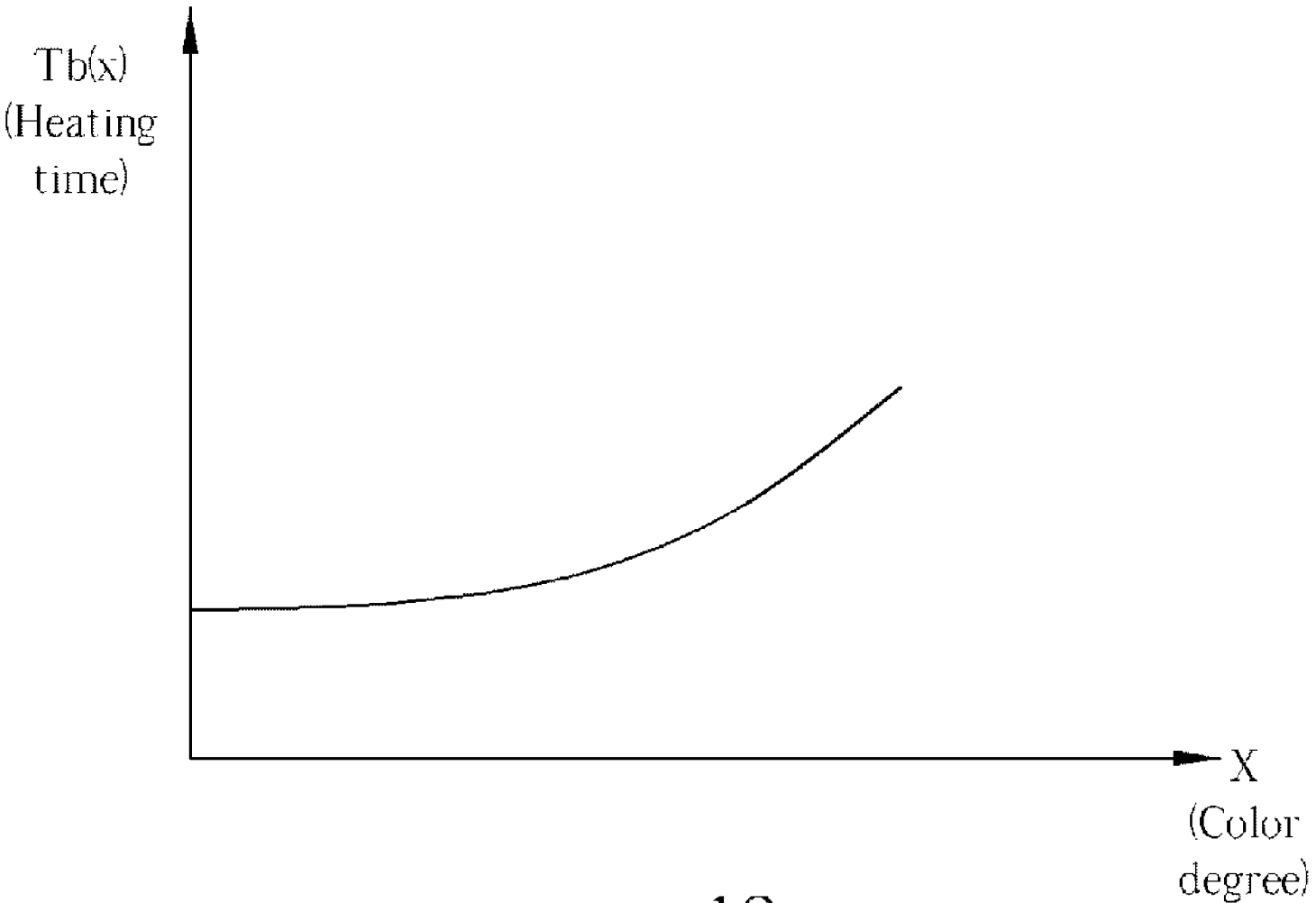
FIG. 13 shows the relationship between the heating time Tb(x) and the original color degree x after brightness adjustment (Δx<0) in the present invention.
Figure 14:
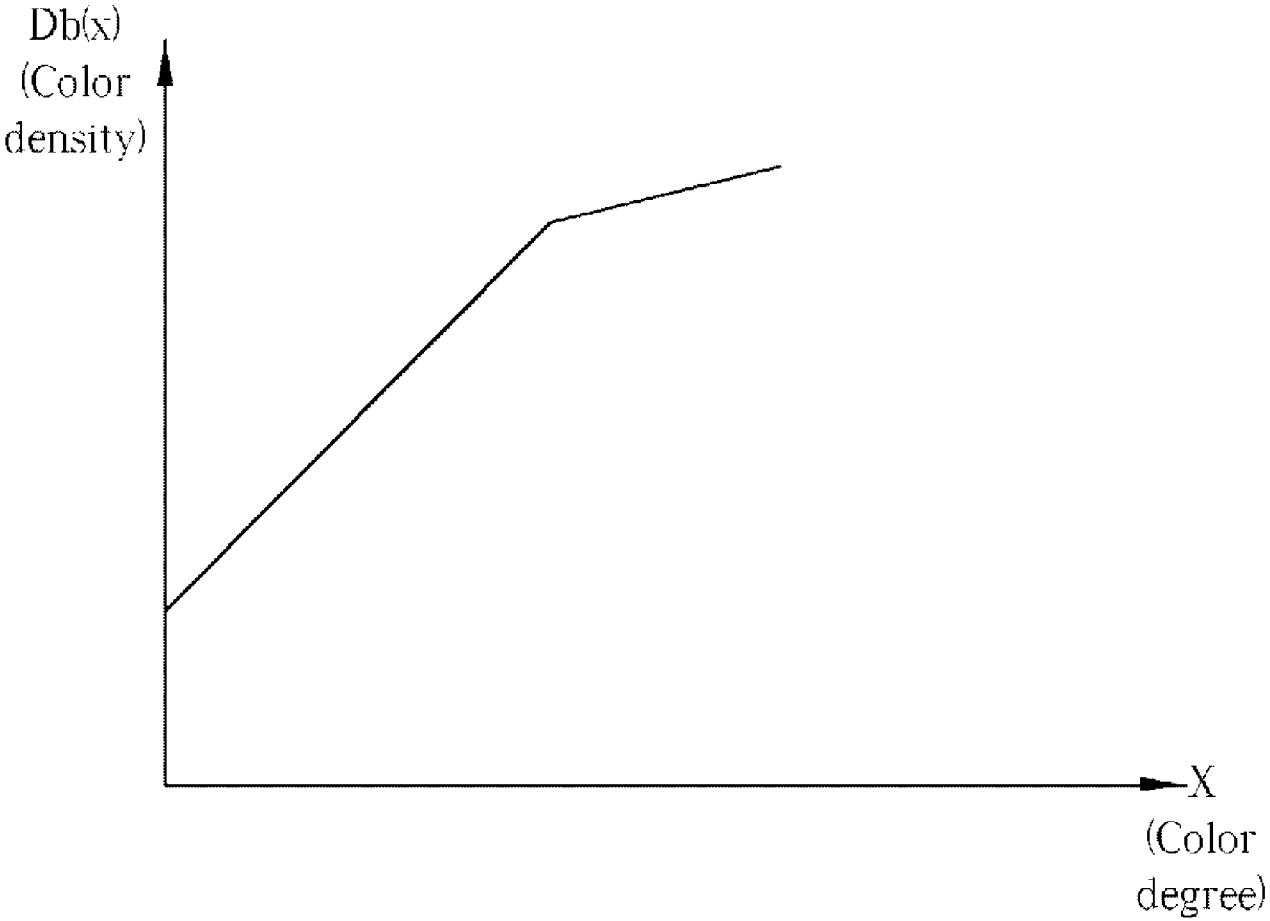
FIG. 14 shows the relationship between the color density Db(x) and the color degree x after brightness adjustment (Δx>0) based on FIG. 1 and FIG. 12 in the present invention.
Figure 15:
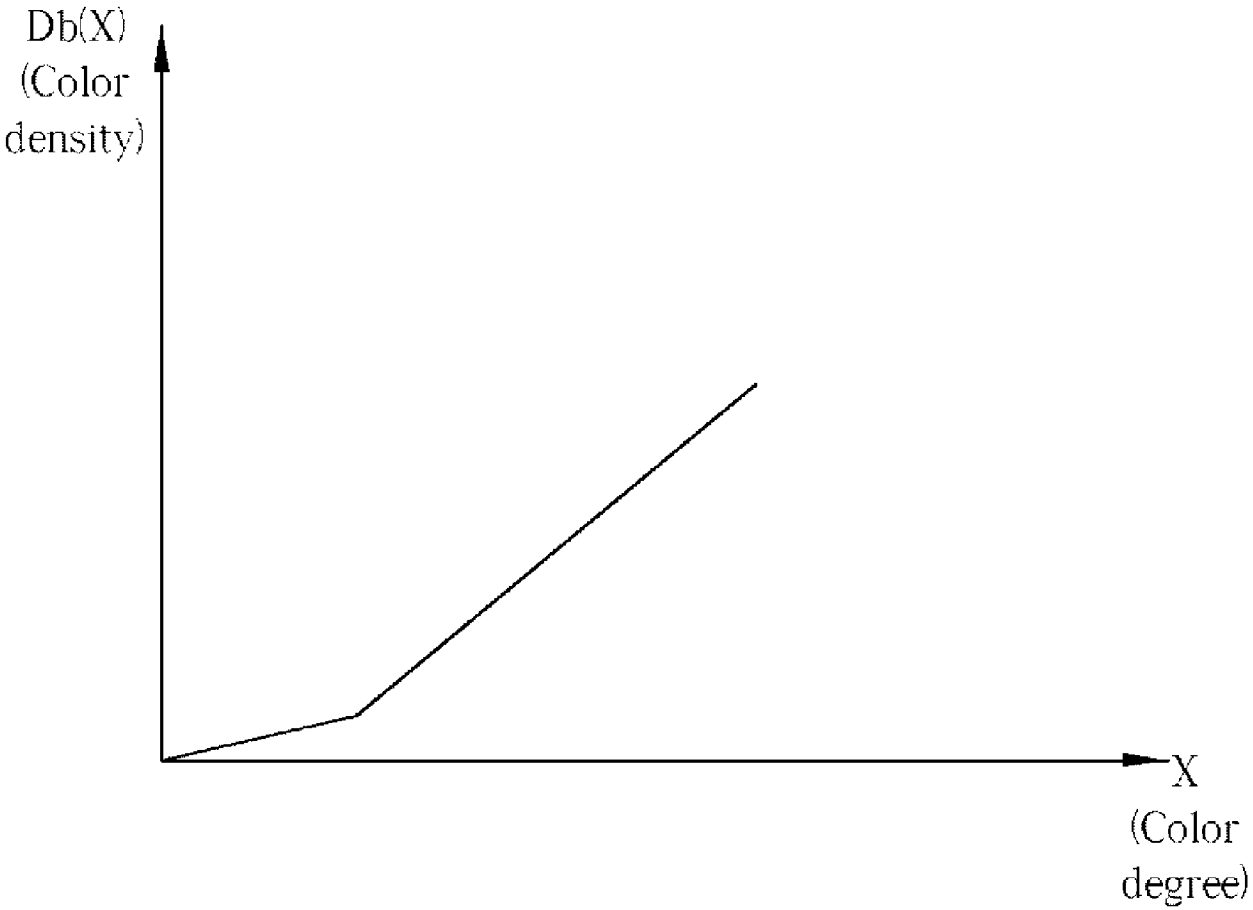
FIG. 15 shows the relationship between the color density Db(x) and the color degree x after brightness adjustment (Δx<0) based on FIG. 1 and FIG. 13 in the present invention.

FIG. 12 shows the relationship between the heating time Tb(x) and the original color degree x after brightness adjustment (Δx>0). FIG. 13 shows the relationship between the heating time Tb(x) and the original color degree x after brightness adjustment (Δx<0). Based on FIG. 1 and FIG. 12, FIG. 14 shows the corresponding relationship between the color density Db(x) and the color degree x after brightness adjustment (Δx>0). Based on FIG. 1 and FIG. 13, FIG. 15 shows the corresponding relationship between the color density Db(x) and the color degree x after brightness adjustment (Δx<0). In the image processing method for the brightness parameter in the present invention, each color degree x has a one-to-one relationship with a color density Db(x), as illustrated in FIG. 14 and FIG. 15. The present invention adjusts the brightness parameter by adjusting the heating time of the original color degree of the brightness parameter, and thus avoids the indistinguishable color degrees of the prior art method, as illustrated in FIG. 6 and FIG. 7.

The following formulae illustrate an image processing method for the contrast parameter according to the present invention:

$$Tc(x)=T(x)+Tc(x,R),\ x=0\text{-}255; \qquad \text{formula 9:}$$

where x is the color degree;

R is a parameter for contrast adjustment;

T(x) represents the original heating time, as illustrated in FIG. 2; and

Tc(x) represents the heating time after contrast adjustment.

Based on FIG. 1 and formula 9, a formula 10 can be obtained to represent the relationship between the heating time and the color degree during contrast adjustment:

$$Dc(x)=D(Tc(x));\ x=0\text{-}255 \qquad \text{formula 10:}$$

where x is the color degree;

Tc(x) represents the heating time after contrast adjustment, as illustrated in formula 9; and Dc(x) represents the color density after contrasts adjustment.

Figure 10:
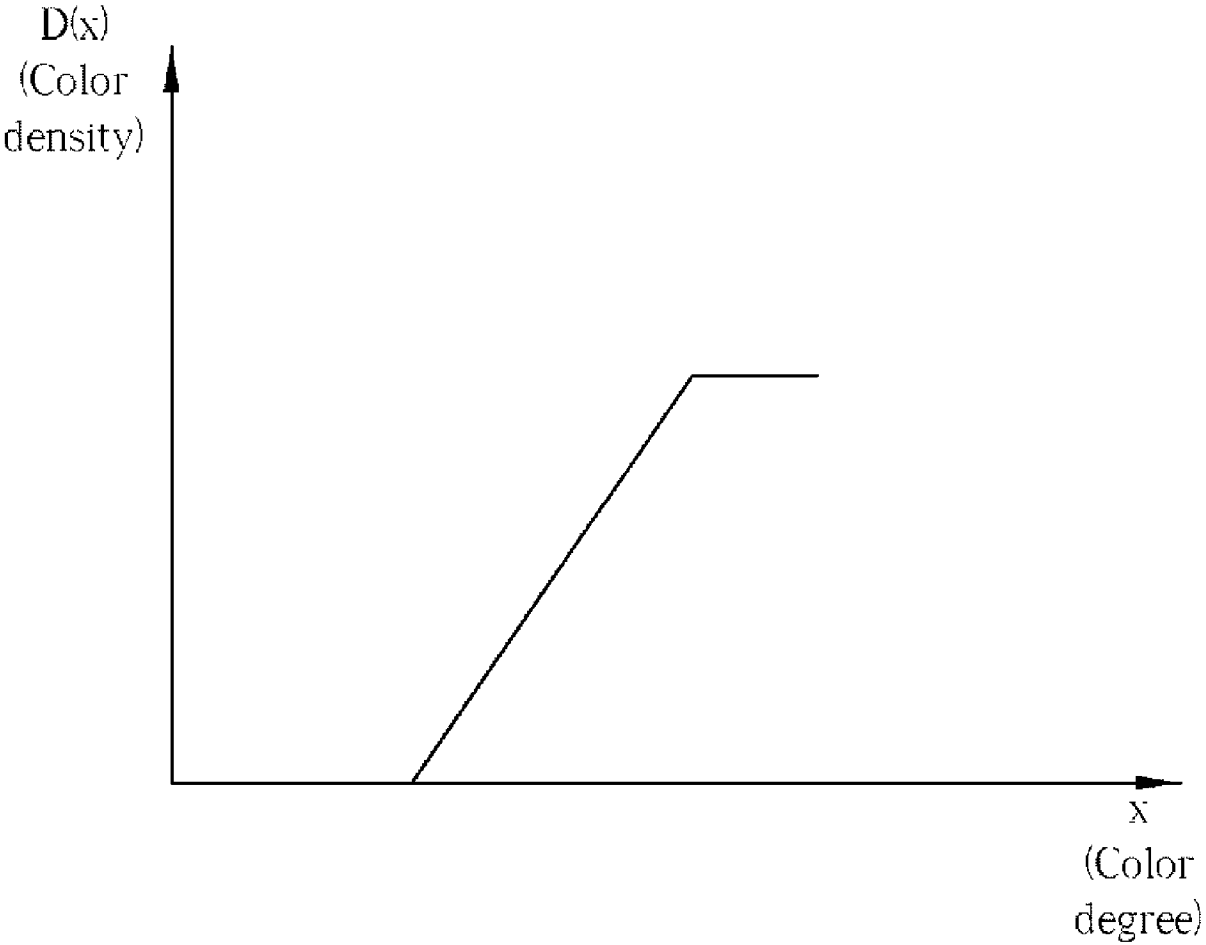
Fig. 10 Prior Art
FIG. 10 shows the relationship between the color density and the color degree after contrast adjustment (R>0) based on FIG. 3 and FIG. 8 in a prior art image processing method.
Figure 11:
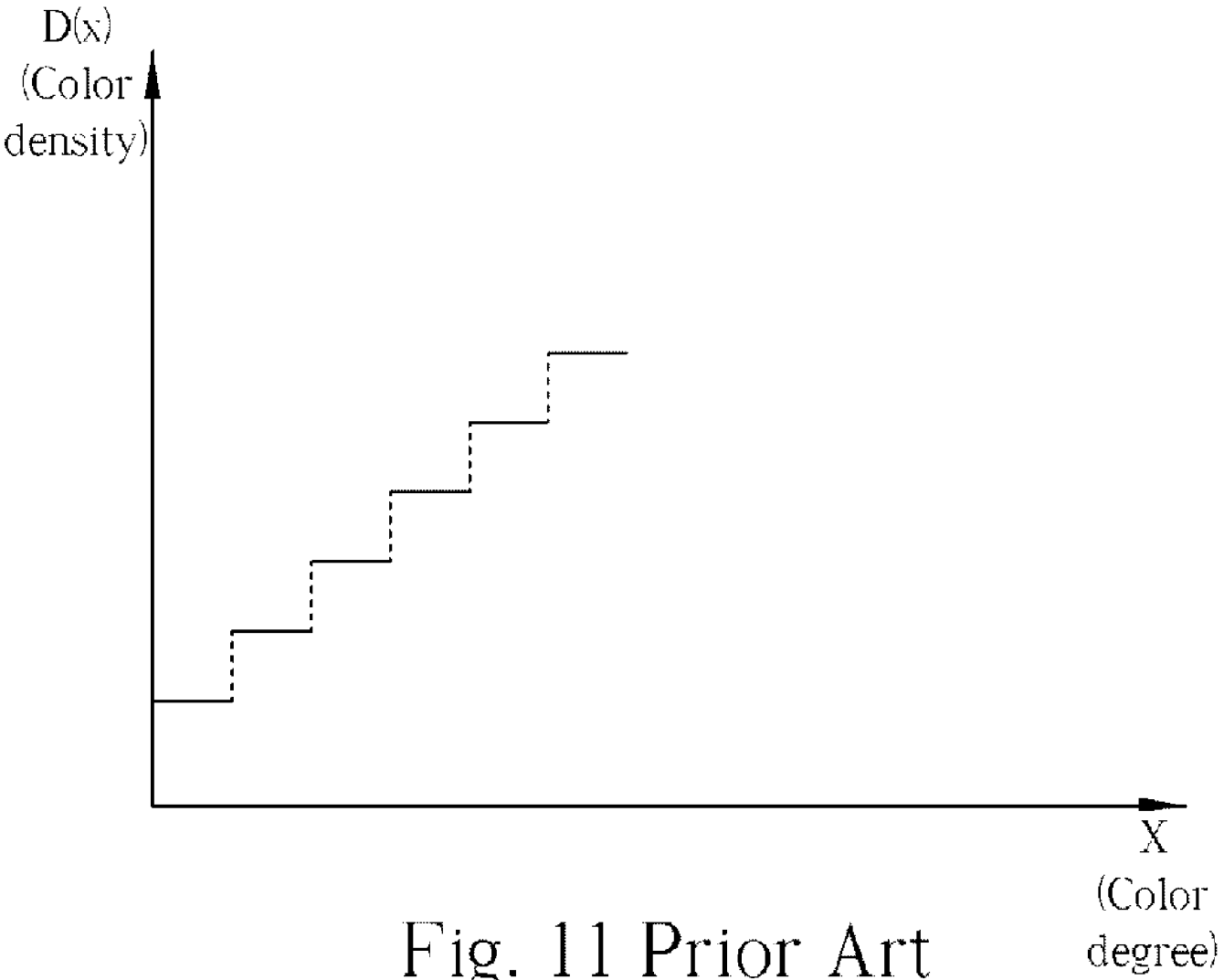
Fig. 11 Prior Art
FIG. 11 shows the relationship between the color density and the color degree after contrast adjustment (R<0) based on FIG. 3 and FIG. 9 in a prior art image processing method.
Figure 16:
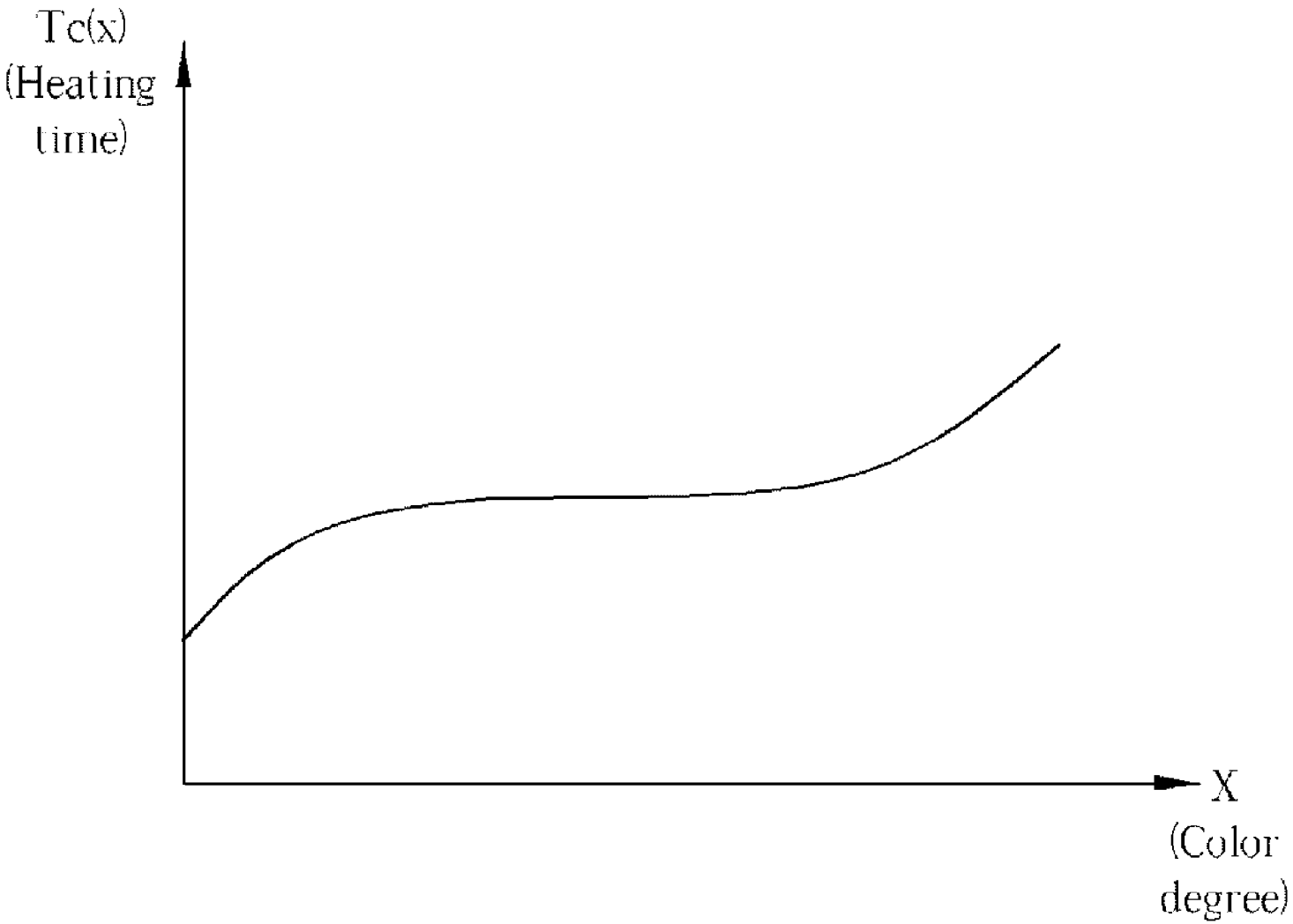
FIG. 16 shows the relationship between the heating time Tc(x) and the original color degree x after contrast adjustment (R>0) in the present invention.
Figure 17:
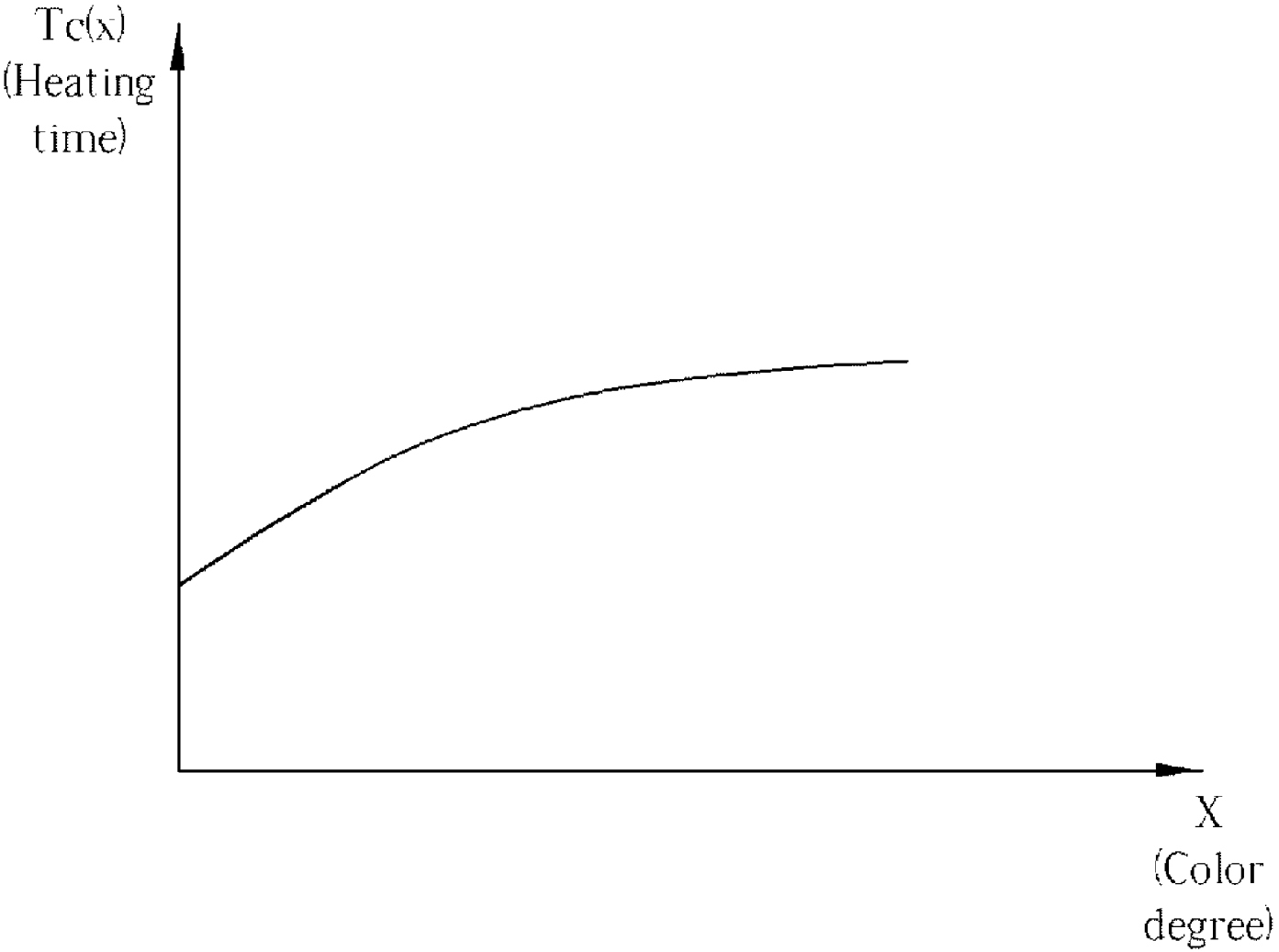
FIG. 17 shows the relationship between the heating time Tc(x) and the original color degree x after contrast adjustment (R<0) in the present invention.
Figure 18:
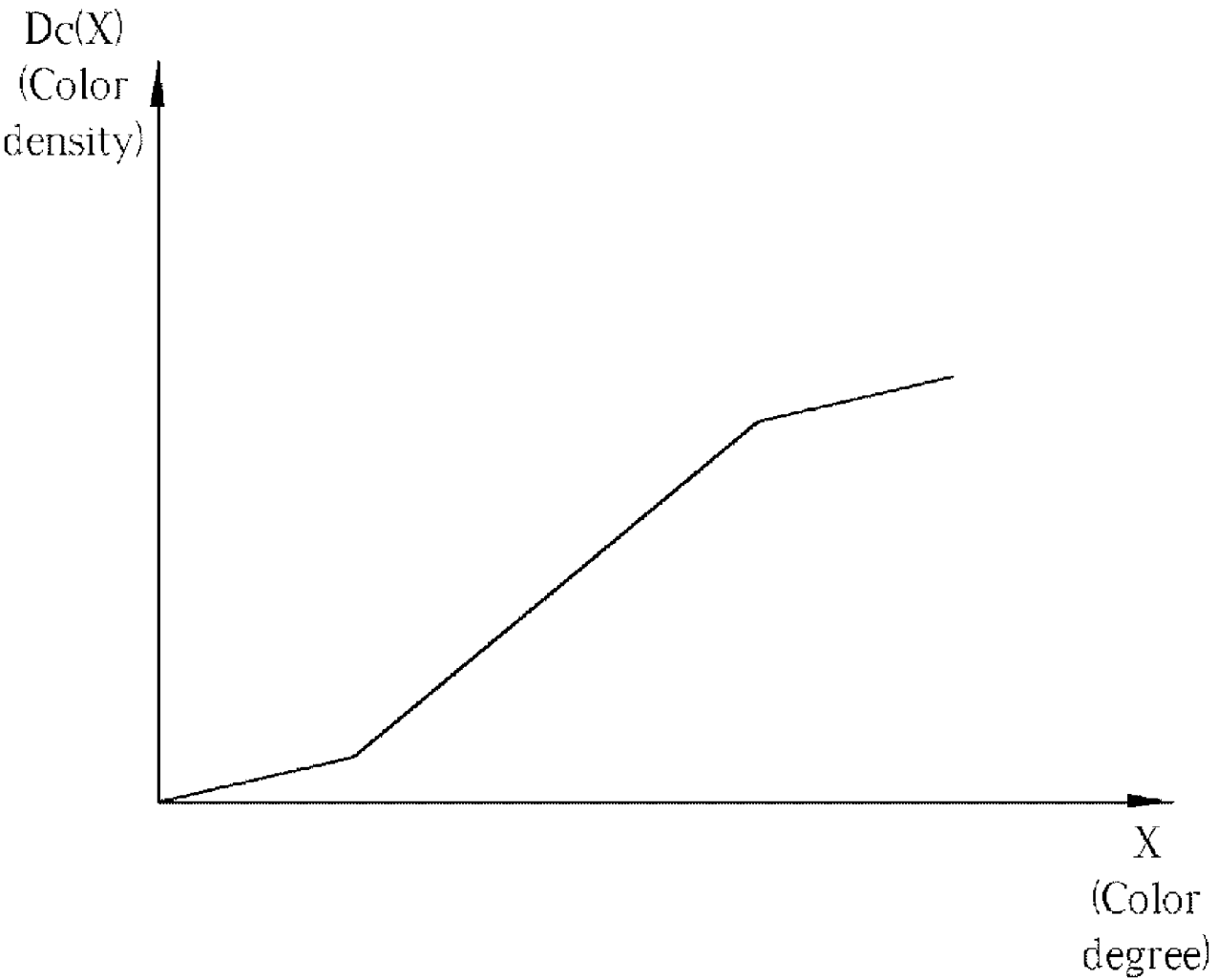
FIG. 18 shows the relationship between the color density Dc(x) and the color degree x after contrast adjustment (R>0) based on FIG. 1 and FIG. 16 in the present invention.
Figure 19:
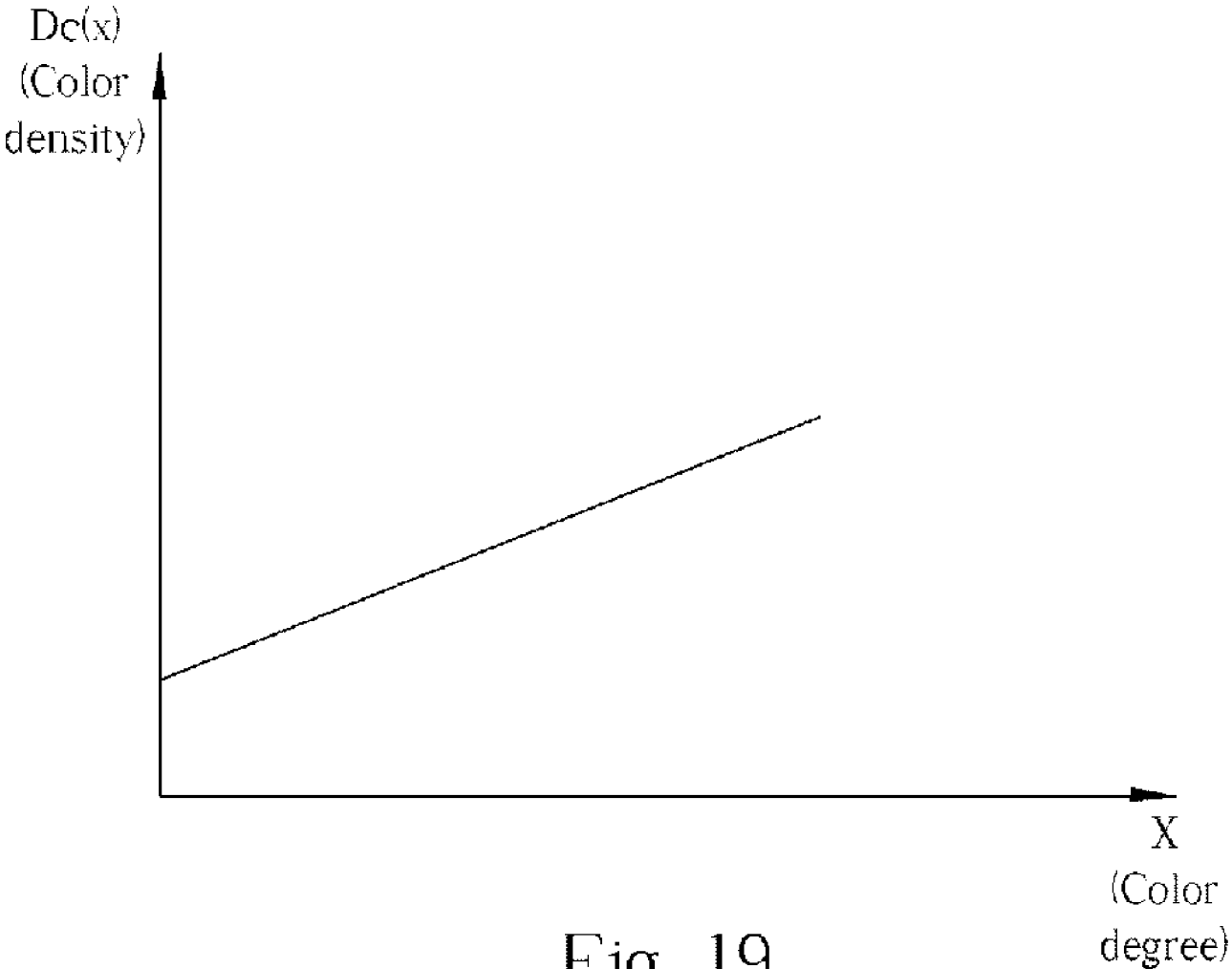
FIG. 19 shows the relationship between the color density Dc(x) and the color degree x after contrast adjustment (R<0) based on FIG. 1 and FIG. 17 in the present invention.

FIG. 16 shows the relationship between the heating time Tc(x) and the original color degree x after contrast adjustment (R>0). FIG. 17 shows the relationship between the heating time Tc(x) and the original color degree x after contrast adjustment (R<0). Based on FIG. 1 and FIG. 16, FIG. 18 shows the corresponding relationship between the color density Dc(x) and the color degree x after contrast adjustment (R>0). Based on FIG. 1 and FIG. 17, FIG. 19 shows the corresponding relationship between the color density Dc(x) and the color degree x after contrast adjustment (R<0). In the image processing method for the contrast parameter in the present invention, each color degree x has a one-to-one relationship with a color density Dc(x), as illustrated in FIG. 18 and FIG. 19. The present invention adjusts the contrast parameter by adjusting the heating time of the original color degree of the contrast parameter, and thus avoids the indistinguishable color degrees of the prior art method, as illustrated in FIG. 10 and FIG. 11.

In the prior art image processing method, the color degrees of each printing parameter are adjusted. This method inevitably results in indistinguishable color degrees after adjustment. In the present image processing method, the heating time of the color degree is being adjusted and a corresponding heating table is provided for adjusting printing parameters such as brightness, contrast, saturation or density. In the present invention, each color degree has a one-to-one relationship with the color density for each parameter adjustment, and thus avoids the undesirable situation of having indistinguishable color degrees, as was the case in the prior art method.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An imaging processing method by adjusting heating time comprising:

(a) providing a first heating table corresponding to a relationship between a first color density and a first heating time;

(b) providing a second heating table corresponding to a relationship between a color degree and a second heating time based on a printing parameter;

(c) providing a function corresponding to a relationship between a second color density and the color degree based on the first heating table and the second heating table, wherein the second heating time has a one-to-one relationship with the color degree, and the color degree has a one-to-one relationship with the second color density.

2. The image processing method of claim 1 wherein the printing parameter is brightness.

3. The image processing method of claim 1 wherein the printing parameter is contrast.

4. The image processing method of claim 1 wherein the printing parameter is saturation.

5. The image processing method of claim 1 wherein the printing parameter is density.

6. The image processing method of claim 1 being implemented in a thermal printer.

* * * * *